US007294005B1

(12) United States Patent
Laukhuf

(10) Patent No.: US 7,294,005 B1
(45) Date of Patent: Nov. 13, 2007

(54) METHOD OF BRANCHING POWER AROUND AN OBSTACLE

(75) Inventor: Gregg Laukhuf, Bryan, OH (US)

(73) Assignee: Pent Technologies, Inc., Kendallville, IN (US)

( * ) Notice: Subject to any disclaimer, the term of this patent is extended or adjusted under 35 U.S.C. 154(b) by 0 days.

(21) Appl. No.: 11/355,694

(22) Filed: Feb. 16, 2006

Related U.S. Application Data

(60) Provisional application No. 60/653,807, filed on Feb. 17, 2005.

(51) Int. Cl.
*H01R 4/60* (2006.01)

(52) U.S. Cl. ..... 439/215

(58) Field of Classification Search ..... 439/215, 439/532, 557

See application file for complete search history.

(56) References Cited

U.S. PATENT DOCUMENTS 4,231,630 A * 11/1980 Propst et al. ..... 439/215
D325,723 S * 4/1992 Gary et al. ..... D13/139.4
6,553,730 B1 * 4/2003 Mueller et al. ..... 52/220.5
6,875,051 B2 * 4/2005 Pizak ..... 439/535

* cited by examiner

*Primary Examiner*—James R. Harvey
(74) *Attorney, Agent, or Firm*—Taylor & Aust, P.C.

(57) ABSTRACT

A modular furniture power distribution system has a plurality of multiconductor electrical cables (42, 44, 46, 48, 62), each having an electrical connector (98, 100, 102) at a first and second ends. There are at least two upstanding partition panels (58), each having an elongated generally horizontally extending channel or raceway (60) for receiving a corresponding electrical cable, and a stanchion or leg (68, 70, 72, 74) for supporting juxtaposed partition panel ends. The support stanchion forms an obstacle precluding direct communication between adjacent partition channels because it provides inadequate clearance to accommodate an electrical coupling between the electrical connector in one channel and the corresponding electrical connector in the other panel. A collar (80) at least partially encircles the leg or other support structure and forms an electrical coupling for circumventing the obstacle and electrically coupling a connector of the cable in one channel with a corresponding connector of the cable in the other channel. A pair of electrical connectors (84, 88) at opposite ends of the collar are adapted to mate with corresponding cable connectors (98, 100) and the mating cable connector and collar connector pairs engage and disengage by relative motion in the direction (90) of channel elongation.

9 Claims, 7 Drawing Sheets

128
82
124
84
108
86
122
94
88
126

150
144
138
148
142
146
140

80

METHOD OF BRANCHING POWER AROUND AN OBSTACLE

CROSS REFERENCE TO RELATED APPLICATIONS

This is a non-provisional application based upon U.S. provisional patent application Ser. No. 60/653,807, entitled "METHOD OF BRANCHING POWER AROUND AN OBSTACLE", filed Feb. 17, 2005.

BACKGROUND OF THE INVENTION

1. Field of the Invention

The present invention relates to power distribution systems, and, more particularly, to power distribution systems of the type utilized with movable partitions or similar modular furniture having raceways for distributing electrical energy.

2. Description of the Related Art

Modular furniture power distribution systems typically may be configured by the user without the need for tools or the services of a professional electrician. Electrical distribution systems for electrified office partitions and similar modular furnishings with power and/or communications wiring running in raceways along the top, beltline or bottom of the partitions have been known for a number of years.

One recurrent problem in electrified office partitions is forming an electrical connection between adjacent panels. The problem has been largely resolved for panels of sufficient width to accommodate jumpers or connections passing around corners, but with more narrow width panels, support posts or other obstacles may preclude wiring within the raceways lying within the lateral confines of the panels. Office furniture manufacturers are coming out with thin partitions (approximately 1" wide). In wider panels there is still enough room around the legs to allow the electrical power distribution components to pass by from panel to panel. However, in the thin panels the legs block off the entire width of the base raceway allowing no room to route any modular electrical components through the corner in the tradition way.

What is needed in the art is a power distribution system adapted to us in thin wall partition raceways.

SUMMARY OF THE INVENTION

The present invention provides a splitter fit around the outside of the obstacle, which in this case is a group of panel legs. The splitter can be arranged in an "X" configuration for 4-way splitting, or a "T" configuration for a 3-way splitting.

The invention comprises, in one form thereof, a power splitter for distributing electrical energy from a source to a plurality of diverse locations in an office furniture environment including an insulating housing mechanically supporting a plurality of electrical connectors spaced about an open region and having outwardly facing openings for receiving corresponding jumper connectors along respective connection axes. The connection axes are generally angularly spaced from one another by integral multiples of a right angle. Electrical conductors within the housing electrically couple the electrical connectors. The open region is configured to at least partially surround a modular furniture wall panel stanchion or other obstruction which forms an obstacle to direct interconnection between the jumpers within the lateral extents of the adjoining wall panels.

Also in general, an electrical coupling for interconnecting a connector of one electrical cable with a like connector of another electrical cable includes a rigid insulating body containing a plurality of conductors and at least two like electrical connectors each having contact receiving openings extending generally outwardly away from a central opening and adapted to mate with a corresponding cable connector. The mating cable connector and collar connector pairs engage and disengage by relative motion toward and away from the central opening. The relative couping motion for one cable connector toward and away from the central opening may be generally orthogonal to or coaxial with the relative coupling motion toward and away from the central opening for the other cable connector. Frequently more than two cable connector/collar connector pairs with combinations of collinear and orthogonal motion are employed. In general, the mating direction for one cable connector and collar connector pair extends generally along integral multiples of a right angle to the mating direction for another cable connector and collar connector pair.

An advantage of the present invention is that power is routed around the outside of an obstruction while still providing all the branching capability of the traditional branching methods.

Another advantage is that all conventional circuitry options may be implemented in thin panels.

A further advantage of the invention is that the power distribution system is well suited to, but is not limited to, narrow wall panel installations, Yet another advantage is the splitter or collar configuration may be "universal" to circumvent a wide variety of stanchions or other obstacles, or may be designed uniquely for a given installation obstruction.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
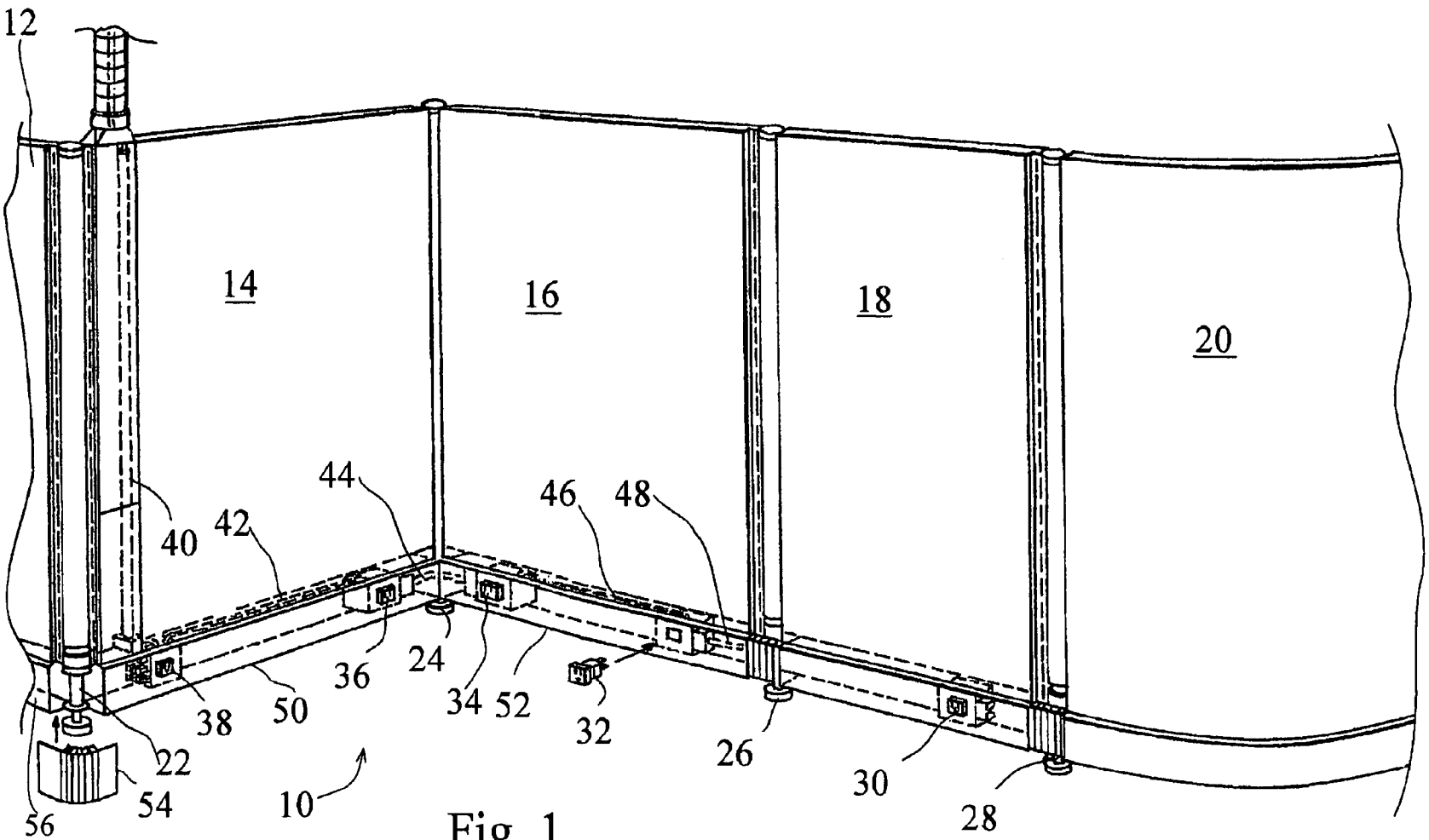
Fig. 1 (prior art)
FIG. 1 is an isometric view of an illustrative prior art modular wall panel system.

Referring now to the drawings, and more particularly to FIG. 1, there is shown an illustrative office or workspace divider panel or partition system 10 which includes a series of wall sections 12, 14, 16, 18 and 20 which rest on posts or supports 22, 24, 26 and 28. Individual wall panels are electrified, that is, provided with electrical outlets or receptacles such as 30, 32, 34, 36 and 38 which are provided with electrical energy from source above by a power downfeed line 40. The individual outlets are electrically interconnected by jumpers such as 42, 44 and 46. Jumper 48 is shown as providing power upwardly from outlet 32 to a utilization device located overhead or higher on a wall panel. Jumper 48 could extend to other electrical components such as receptacle 30 as desired. The electrical outlets and interconnecting jumpers are disposed in panel raceways such as 50, 52 and 56 which interconnect to form a channel which extends along the bottom edges of the several panels. Note particularly, the region near the lower left corner of the system 10 where the decorative cover 54 has been removed exposing the channels 50 and 56. The channel width is seen to be considerably greater than the thickness of the leg 22. This allows adequate space within the channel for the jumpers such as 44 to pass around the leg or support while remaining in the channel. As partition thickness is reduced, this space may no longer be available necessitating recourse to other techniques.

Figure 2:
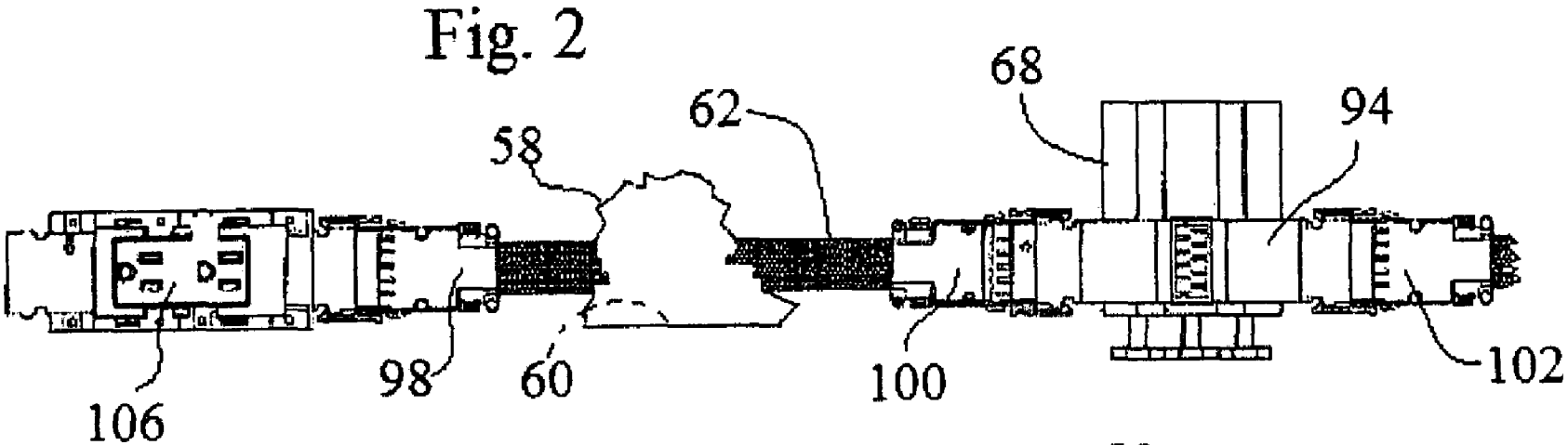
FIG. 2 is a side elevation view of an electrical distribution system adapted to a thin wall environment.
Figure 3:
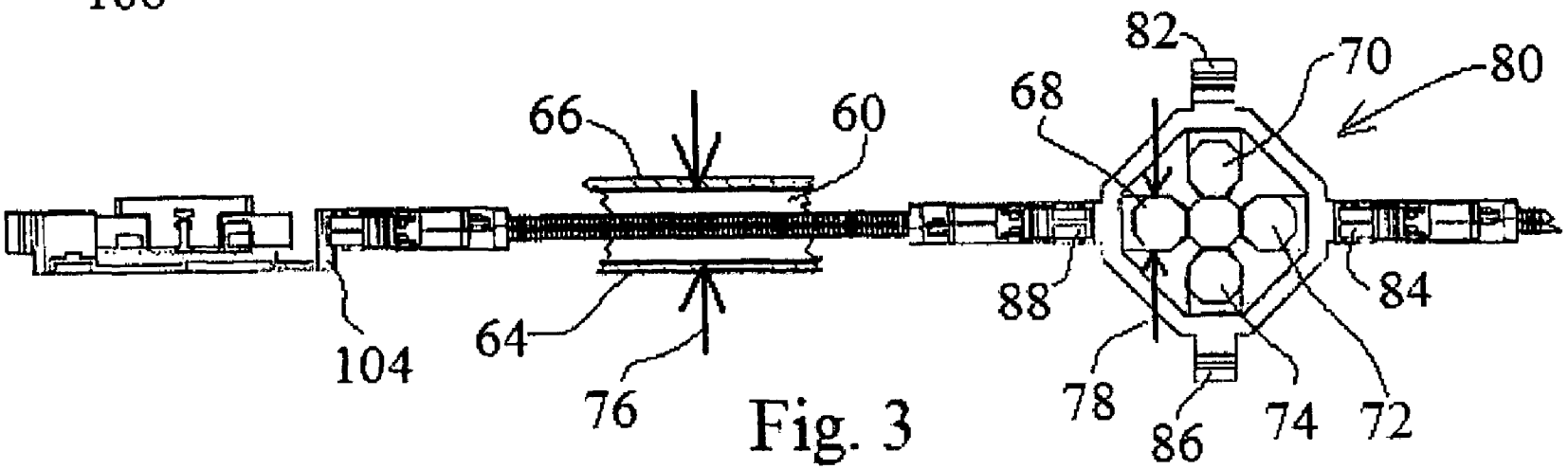
FIG. 3 is a top plan view of the distribution system of FIG. 2.
Figure 4:
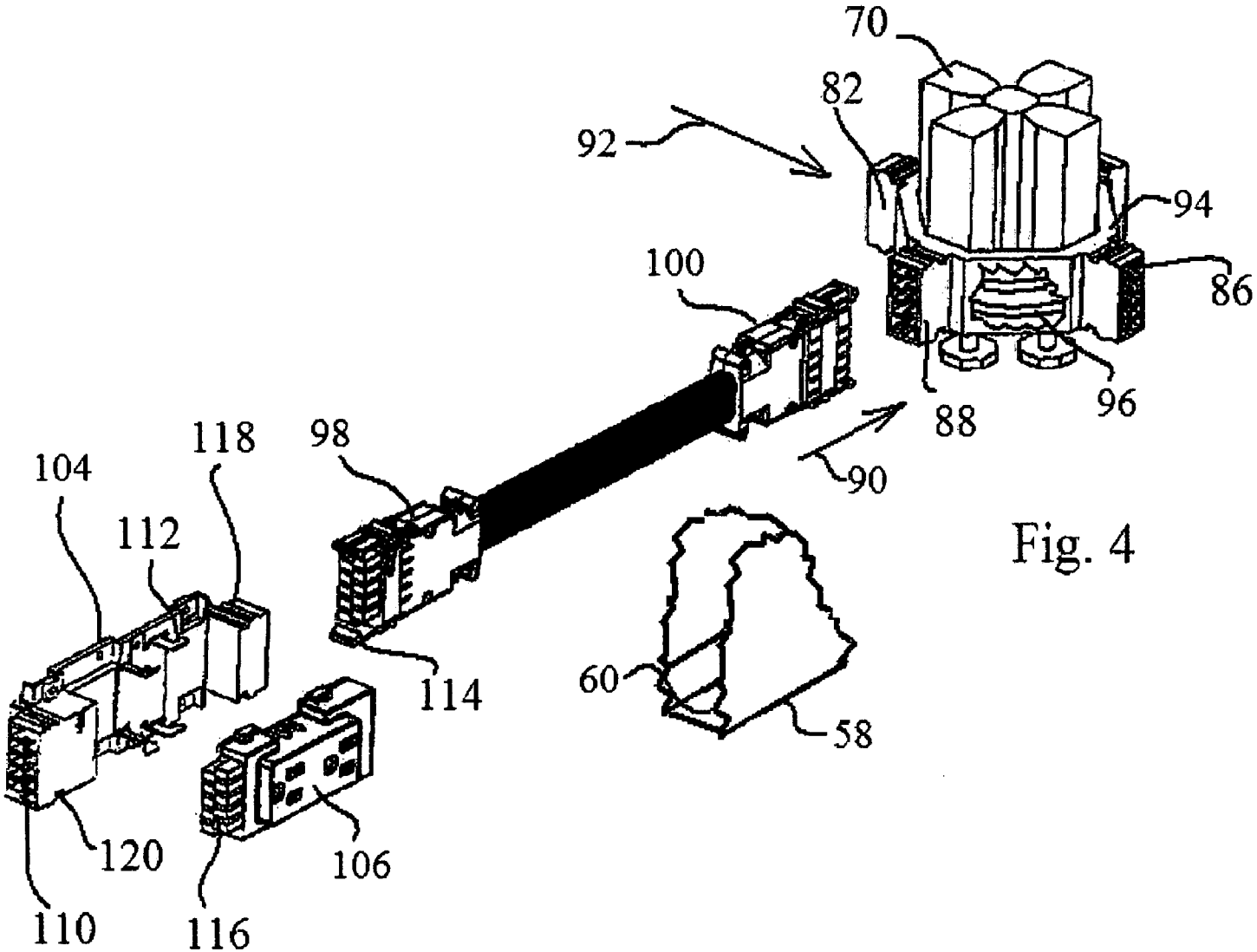
FIG. 4 is an exploded perspective view of the distribution system of FIGS. 2 and 3.

FIGS. 2-4 shown a splitter designed to branch power around an obstacle, in particular, in a thin office panel system where the legs block off the ends of the base raceway and/or occupy the space at the intersection of adjacent panels leaving inadequate room for power distribution components. In FIGS. 2-4, a broken-away portion of an exemplary wall partition 58 has a base raceway or channel 60 for receiving a flexible jumper cable 62. The wall partition may be of any suitable construction, but is here illustrated as a simple U-shaped open-topped metal or plastic trough with a pair of thin wall panels or portions 64 and 66 upstanding therefrom. The raceway may be located along the bottom of the panel as illustrated in FIG. 1, along the top, or may be at a beltline height for providing electrical outlets at convenient desk or tabletop locations. The raceways may also be of any suitable construction. Jumpers or cables having any suitable connectors may be employed. Illustrated are jumpers with like connectors 98, 100, 102 at opposite ends for connection to adjacent modular furniture wiring components. These connectors are adapted to engage other connectors such as such as 82, 84, 86 or 88 in an end to end manner for effecting connections at corners and with other electrical components. The jumpers may include multiple circuits having shared or independent neutral conductors as is conventional in the art. The connectors may also have indicia or an asymetrical aspect to prevent "upside down" interconnection and preserve the integrity of multiple circuits. The connectors shown are especially well suited to a narrow panel environment. The connectors each have an electrically insulating housing partially open at one end which is adapted to mate with the corresponding open portion of the housing of another connector. A plurality of terminals are disposed within each connector housing.

The partition 58 is supported by legs with an exemplary leg 68 shown. The support legs may be individual leg portions, one for each panel as shown at 68, 70, 72 and 74, a common post may support all panels meeting at a particular corner, or any other suitable stanchion or leg structure which is compatible with the chosen partition may be employed. Note the overall thickness or lateral extent of the partition (measured vertically in FIG. 3) is not much greater than the overall thickness (arrows 78) of the leg portion 68. Further, the available interior channel width for accepting a jumper is shown by the arrows 76 while the leg portion 68 thickness is shown by the arrows 78. The space available within the channel width is not sufficient to accommodate both the jumper and leg portion 68, let alone accommodate the jumper and entire leg structure including the other three leg portions.

The jumper accommodation problem is solved in FIGS. 2-4 by providing a collar 80 which functions as a power splitter to divert the conductor path around the obstruction. The collar or power splitter 80 functions to distribute electrical energy from a source such as the downfeed 40 of FIG. 1 to a plurality of diverse locations in the office furniture environment. Power splitter 80 has an insulating housing 94 which mechanically supports a plurality of electrical connectors 82, 84, 86 and 88 which are spaced about an open region 108 (FIG. 8) for accommodating an obstacle such as the leg or stanchion assembly. As illustrated, the open region 108 is configured to surround the modular furniture wall panel support post. Electrical conductors such as 96 within the housing 94 electrically couple the electrical connectors.

Figures 8, 9, 10, 11, 12, 13, 14, 15:
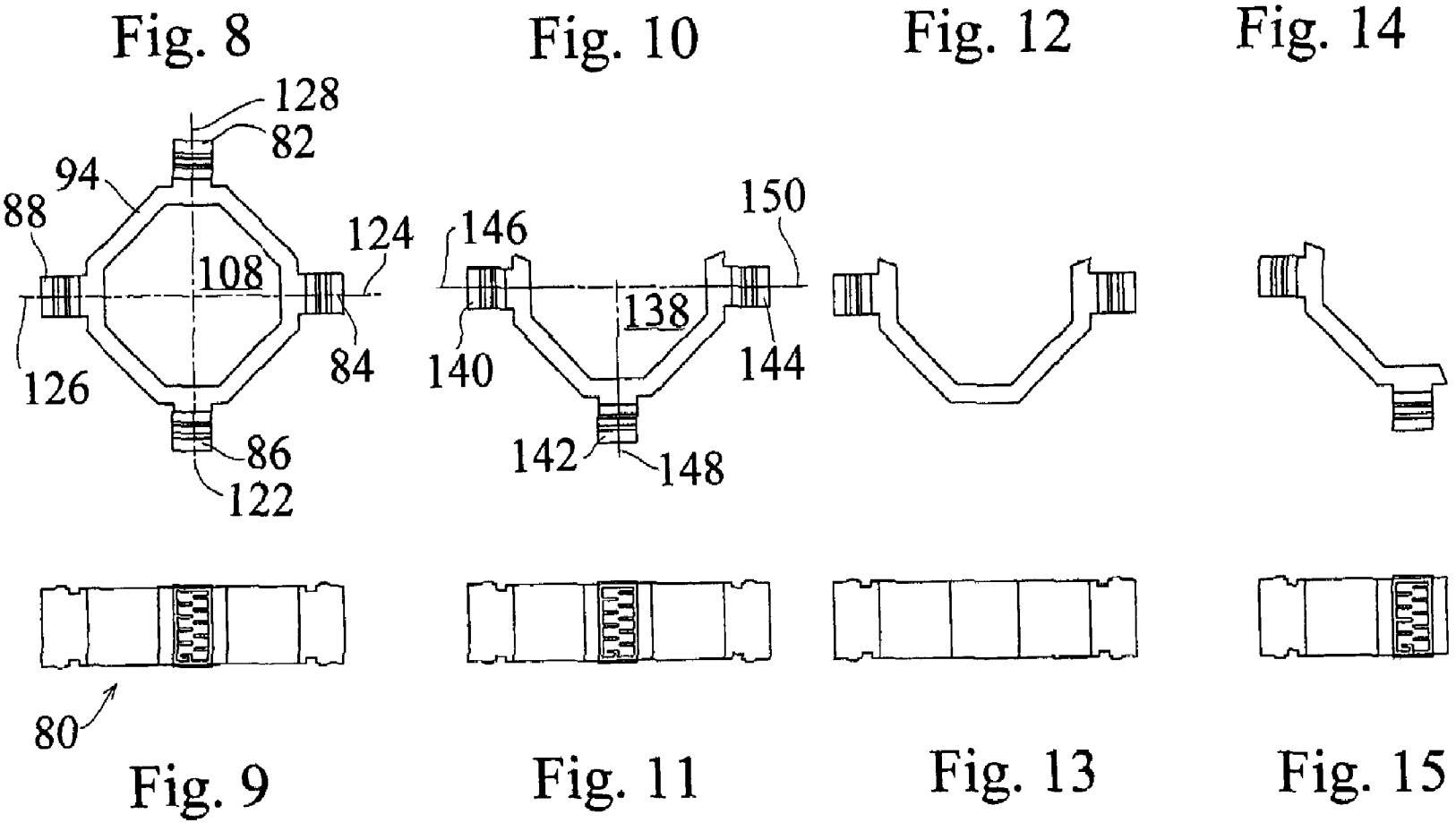
FIG. 8 is a top plan view of the custom four-way splitter of FIGS. 2-4.
FIG. 9 is a side elevation view of the four-way splitter of FIG. 8.
FIG. 10 is top plan view of a three-way splitter similar to the splitter of FIG. 8.
FIG. 11 is a side elevation view of the three-way splitter of FIG. 10.
FIG. 12 is top plan view of a two-way straight through splitter similar to the splitter of FIG. 8.
FIG. 13 is a side elevation view of the two-way splitter of FIG. 12.
FIG. 14 is top plan view of a two-way ninety degree splitter similar to the splitter of FIG. 8.
FIG. 15 is a side elevation view of the two-way splitter of FIG. 14.

The several electrical connectors have outwardly facing openings for receiving corresponding jumper connectors such as 100 and 102 along respective connection axes. Connection axis directions 90 and 92 are illustrated in FIG. 4 for the connectors 88 and 82 respectively. The connection axis direction 90 coincides with the direction of elongation of the channel 58. The connection axis directions 90 and 92 are angularly displaced by ninety degrees to facilitate electrical couplings at corners, e.g., between panels 14 and 16 in FIG. 1. FIG. 8 shows four electrical connectors equally angularly spaced about the open region 108 with respective connection axes 122, 124, 126 and 128 generally angularly spaced from one another by integral multiples of a right angle.

The electrical connectors such as 88 include individual contacts which mate with corresponding individual contacts within the jumper connectors such as 100. The respective mating contacts may be recessed male and female contacts or hermaphroditic contacts of known type may be employed. A modular furniture power distribution system may employ numerous splitters of various configurations. At each splitter, there will typically be at least two multiconductor electrical cables as illustrated in FIGS. 2 and 3 with each having an electrical connector 100 or 102 for mating with the splitter as well as connectors at respective second ends, e.g., connector 98 for connection to, for example, a single sided molded distribution 104. Distribution 104 may have connectors such as 110 at its opposite ends, one for receiving connector 100 and the other for interconnecting the second connector of cable 62 with a like connector of a further cable (not shown). The distribution 104 also includes electrical contacts (not visible, but facing away from connector 110 in the opposite direction) for receiving the receptacle 106 connector 116 for energizing the receptacle. Receptacle 106 is mechanically retained in the distribution by mechanical latches such as 112. The connectors of jumper 62 include jumper connector latches such as 114 which mechanically engage notches such as 118 and 120 to retain the jumper connected to the distribution 104 and splitter 80.

Figure 5:
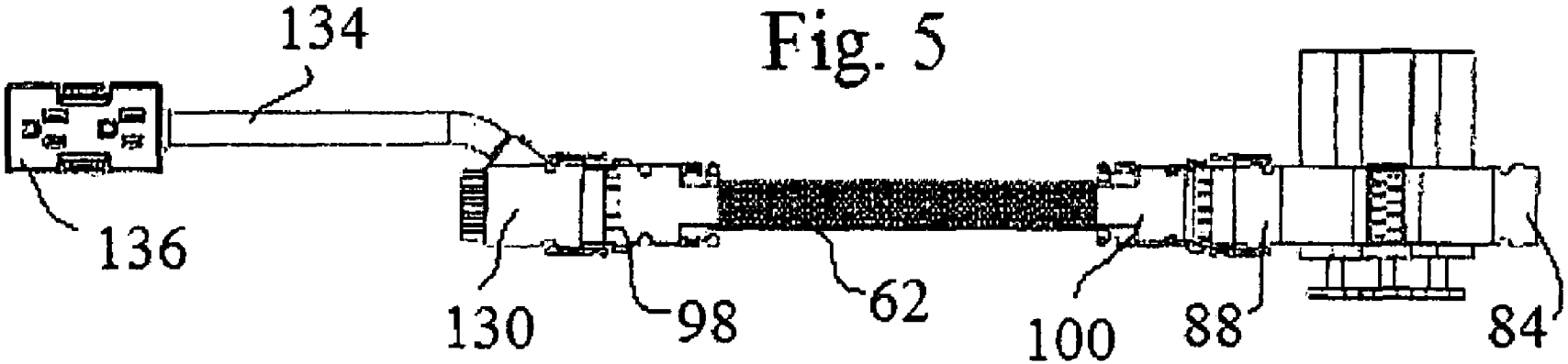
FIG. 5 is side elevation view of one variation on a thin wall electrical distribution system.
Figure 6:
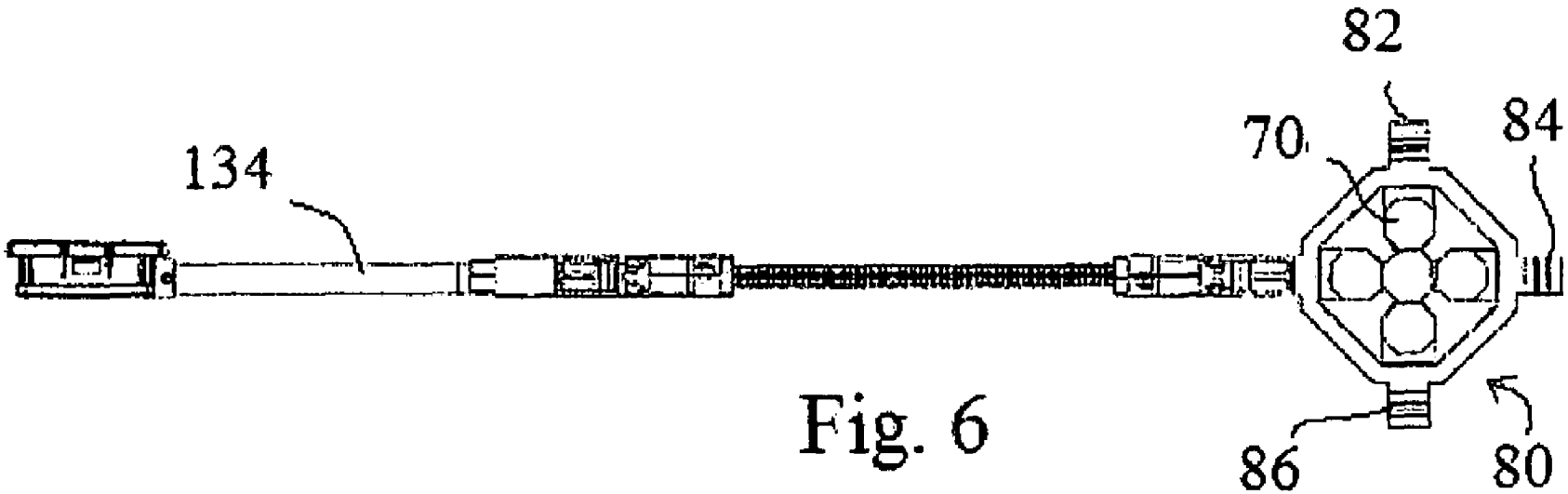
FIG. 6 is a top plan view of the distribution system of FIG. 5.
Figure 7:
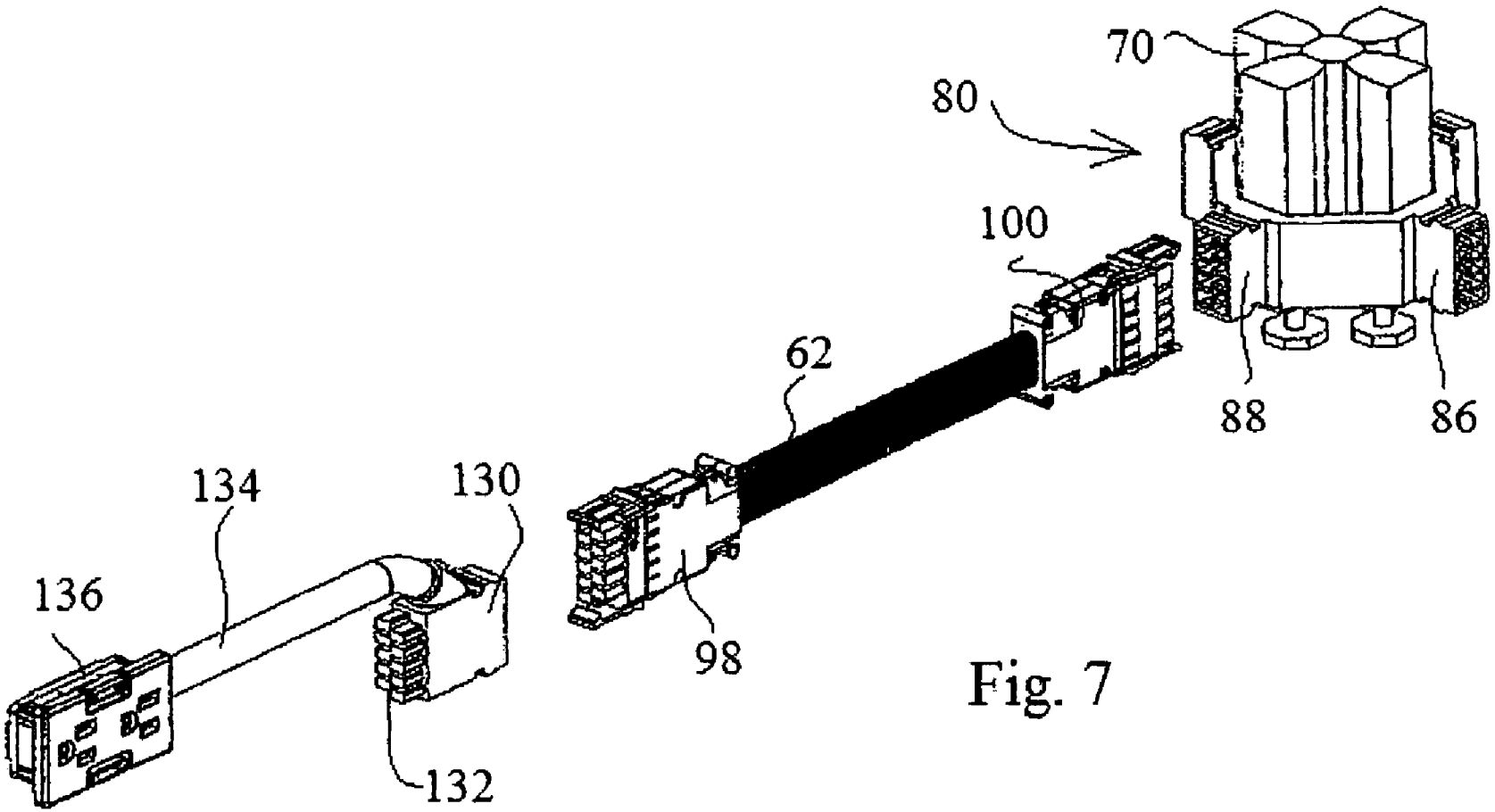
FIG. 7 is an exploded perspective view of the distribution system of FIGS. 5 and 6.

FIGS. 5-7 illustrate one of many possible variations on the modular furniture power distribution system. Four way splitter 80 and the associated connectors 82, 84, 86 and 88 as well as jumper 62 and its associated connectors 98 and 100 are substantially the same as described in conjunction with FIGS. 2-4. Again, the splitter encircles an obstacle such as the stanchion including exemplary post portion 70. A molded power "T" coupler 130 has connectors 132 and another facing in the opposite direction from the opposite end for coupling connector 98 of cable 62 with a like connector of a further cable (not shown), and has an obliquely extending electrical cable 134 in a metal conduit for connecting with an electrical receptacle 136.

The embodiments of FIGS. 2-4 and of FIGS. 5-7 are both highly suited to deployment in a thin-walled office partition array. Note that none of the plug insertion connections require movement in the direction normal to the wall surface and that none of the components are positioned laterally beside one another thereby minimizing the lateral space required to accommodate the components. This thin profile aspect is particularly visible in FIGS. 3 and 6.

FIGS. 8 and 9 are top and side elevation views respectively of the four-way splitter 80 already discussed. Note the insertion axes (connection direction or axis of coupling) 122, 124, 126 and 128 are spaced one from another by integral multiples of ninety degrees. Splitter 80 may be employed for less than four-way splitting tasks, but FIGS. 10-15 illustrate variations on splitter 80 particularly suited to use in situations where less than four jumpers are joined. Other than the number of connectors and the shape of the obstacle accommodating space, the splitters shown in the remaining figures function much the same as splitter 80. For example, In FIG. 10, there are three connectors 140, 142 and 144 and their axes of coupling are shown at 146, 148 and 150. Axes 140 and 144 are collinear and at a straight angle to one another while axis 148 is perpendicular to the other two. The opening 138 is only partially surrounded by the collar.

In FIGS. 10 and 11, a three-way splitter suitable for use where one wall panel ends at a junction between two other aligned panels, that is, at a "T" junction, is shown. Of course, this splitter could be used at a four wall junction where electrification of one or more wall sections was not desired. Any one of the connectors could be coupled to a power source to distribute power to the other two connectors and their associated wiring.

FIGS. 12 and 13 show a two-way splitter for "straight through" interconnection of wiring in raceways of two aligned wall panels, for example, between panels 16 and 18 of FIG. 1, while FIGS. 14 and 15 show a splitter suitable for right-angled interconnection of wiring in raceways of two perpendicular wall panels, for example, as shown between panels 14 and 16 in FIG. 1.

Figure 16:
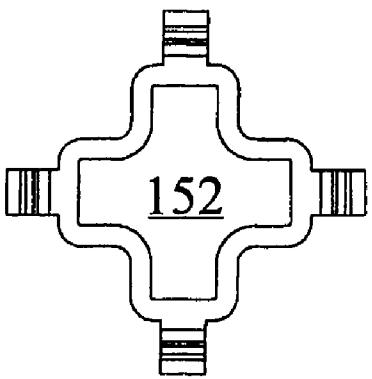
FIG. 16 is a top plan view of a variation on the custom four-way splitter of FIGS. 2-4, 8 and 9.
Figure 17:
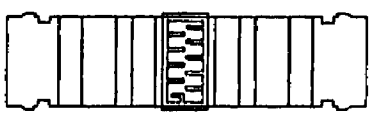
FIG. 17 is a side elevation view of the four-way splitter of FIG. 16.

FIGS. 16 and 17 are top and side elevation views respectively of a different four-way splitter which is electrically equivalent to that shown in FIGS. 8 and 9, but which has a central opening 152 configured to more snugly encircle the four post stanchion of FIGS. 2-7. The collar may be configured to circumvent any of a wide variety of other obstacle shapes as desired.

Figure 18:
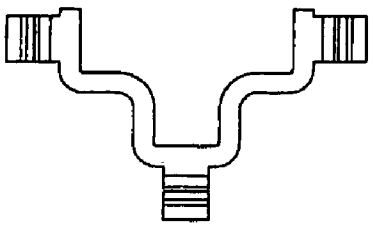
FIG. 18 is top plan view of a three-way splitter similar to the splitter of FIG. 16.
Figure 19:
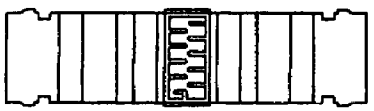
FIG. 19 is a side elevation view of the three-way splitter of FIG. 18.

A similarly configured three-way splitter suitable for use where one wall panel ends at a junction between two other aligned panels is shown in FIGS. 18 and 19. This splitter is electrically the same as the splitter illustrated in FIGS. 10 and 11, but has the central opening configured to more closely conform to the particular stanchion configuration shown in FIGS. 2-7.

Figure 20:
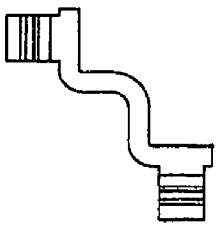
FIG. 20 is top plan view of a two-way ninety degree splitter similar to the splitter of FIG. 16.
Figure 21:
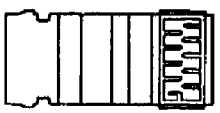
FIG. 21 is a side elevation view of the two-way splitter of FIG. 20.
Figure 22:
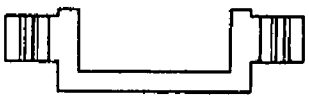
FIG. 22 is top plan view of a two-way straight through splitter similar to the splitter of FIG. 16.
Figure 23:
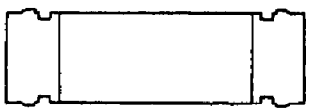
FIG. 23 is a side elevation view of the two-way splitter of FIG. 22.

FIGS. 20 and 21 show a two-way splitter suitable for right-angled interconnection of wiring in raceways of two perpendicular wall panels while FIGS. 22 and 23 illustrate a splitter for "straight through" interconnection of wiring in raceways of two aligned wall panels. The term "splitter" is intended to encompass the simpler two way connections of FIGS. 12-15 and 20-23 as well as the disclosed three-way and four-way splitters.

The central opening shapes of FIGS. 8-15 are adapted to a wider variety of post configurations than those of FIGS. 16-23. Regardless of the number of connectors, in every variation shown in FIGS. 8-23, the axes of coupling are spaced one from another by integral multiples of ninety degrees.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A modular furniture power distribution system, comprising:

at least two multiconductor electrical cables, each having an electrical connector at a first end thereof;

at least two upstanding partition panels, each having an elongated generally horizontally extending channel for receiving a corresponding electrical cable;

a stanchion for supporting juxtaposed partition panel ends, the stanchion forming an obstacle precluding direct communication between adjacent partition channels and providing inadequate clearance to accommodate electrical coupling between the electrical connectors; and a collar at least partially encircling the stanchion and forming an electrical coupling for circumventing the obstacle and electrically coupling the connector of the cable in one channel with a corresponding connector of the cable in the other channel.

2. The power distribution system of claim 1, wherein there are at least three multiconductor cables and at least three upstanding partition panels, the stanchion supporting juxtaposed partition panel ends of all three partition panels, the collar forming an electrical coupling for connecting a cable in one channel with corresponding cables in each of the other channels.

3. The power distribution system of claim 1, wherein there are exactly four multiconductor cables and exactly four upstanding partition panels, the stanchion supporting juxtaposed partition panel ends of all four partition panels in an orthogonal configuration, the collar completely encircling the stanchion and forming an electrical coupling for connecting a cable in one channel with corresponding cables in each of the other channels.

4. The power distribution system of claim 3, further including four electrical connectors equiangularly disposed about the outer periphery of the collar, each adapted to mate with a corresponding cable connector, the mating cable connector and collar connector pairs engaging and disengaging by relative motion in the direction of elongation of the associated channel.

5. The power distribution system of claim 4, wherein the cables and collar connectors lie within the lateral extents of the corresponding partition panels while the collar extends beyond the lateral extents of the partition panels.

6. The power distribution system of claim 1, wherein the collar comprises a rigid insulating body containing a plurality of conductors and at least two electrical connectors, each adapted to mate with a corresponding cable connector.

7. The power distribution system of claim 6, wherein the mating cable connector and collar connector pairs engage and disengage by relative motion in the direction of elongation of the corresponding channel.

8. The power distribution system of claim 1, wherein the at least two multiconductor electrical cables, each have an electrical connector at respective second ends thereof, and further comprising a single sided molded distribution having connectors at opposite ends thereof for coupling a second connector of one cable with a like connector of a further cable, and having electrical contacts and mechanical latches for receiving and energizing a modular receptacle.

9. The power distribution system of claim 1, wherein the at least two multiconductor electrical cables, each have an electrical connector at respective second ends thereof, and further comprising a molded power "T" coupler having connectors at opposite ends thereof for coupling a second connector of one cable with a like connector of a further cable, and having an obliquely extending electrical cable for connecting with an electrical receptacle.

* * * * *